United States Patent [19]
Schaming
[11] 4,076,222
[45] Feb. 28, 1978

[54] RUNOUT COOLING METHOD AND APPARATUS FOR METAL ROLLING MILLS

[76] Inventor: Edward J. Schaming, P.O. Box 1070, Butler, Pa. 16001

[21] Appl. No.: 706,516

[22] Filed: Jul. 19, 1976

[51] Int. Cl.² ..... C21D 1/62
[52] U.S. Cl. ..... 266/111; 134/64 R; 134/122 R; 266/113
[58] Field of Search ..... 134/64, 122; 148/153; 266/111, 113

[56] References Cited
U.S. PATENT DOCUMENTS 3,410,734 11/1968 Taylor ..... 148/153 X
3,856,281 12/1974 Bertolotti ..... 134/64

*Primary Examiner*—Roy Lake
*Assistant Examiner*—Paul A. Bell
*Attorney, Agent, or Firm*—D. Paul Weaver

[57] ABSTRACT

To evenly cool metal strip stock emerging from a rolling mill, a series of spaced elevated manifolds receive cooling water from a controllable source and deliver water continuously across the full width of the strip stock in the form of falling solid curtains or walls of water.

3 Claims, 5 Drawing Figures

FIG. 3
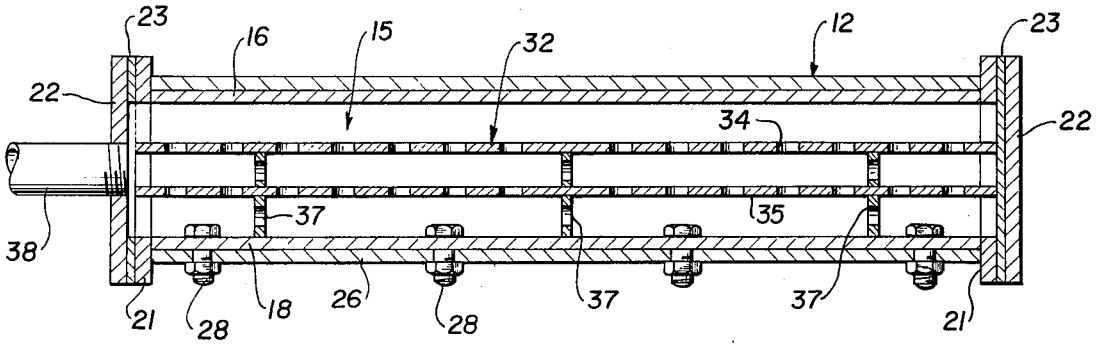
FIG. 4
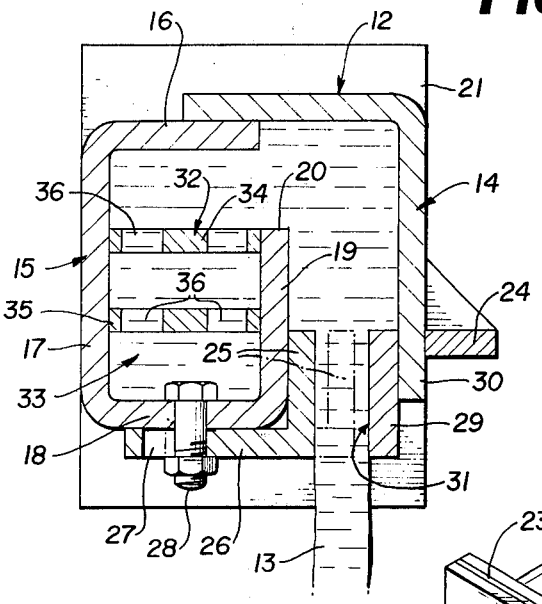
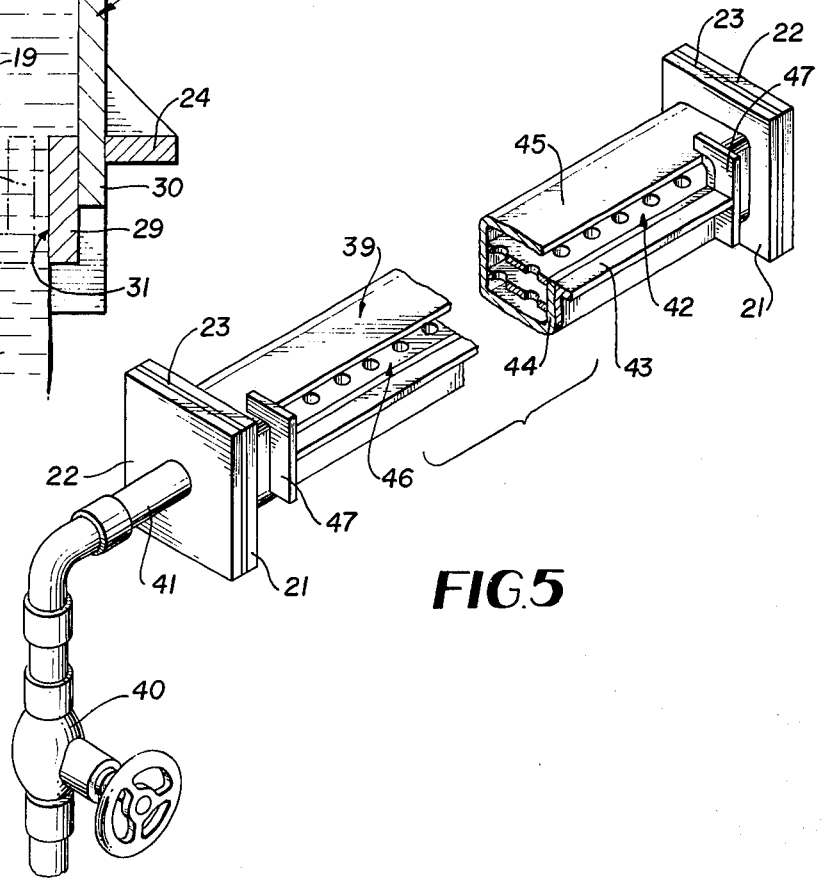
FIG. 5

RUNOUT COOLING METHOD AND APPARATUS FOR METAL ROLLING MILLS

BACKGROUND OF THE INVENTION

Traditionally, rolled metal strip stock, such as steel, aluminum or copper strip, is cooled by a variety of runout cooling systems of varying degrees of sophistication. In all such cases, difficulty has been encountered in controlling the cooling of the product, generally due to an insufficiency of water in the system which commonly relies on various arrangements of spray nozzles or other devices which direct individual streams of water onto the strip stock while it is moving.

There has been particular difficulty in the prior art in connection with cooling heavier gage products running at high speeds. It is in connection with these particular problems and deficiencies in the prior art that the present invention has been conceived and developed to allow a more controlled and rapid cooling of the product in various gages while moving at high speed. Experimentation and mathematical analysis has made possible a more complete understanding of the way in which a laminar cooling system functions, and because of this knowledge, it is now possible to predict the approximate cooling efficiency and capacity of a given laminar header or manifold according to the invention, so that the same can be designed accurately for various installations where the requirements differ.

The invention is characterized by structural simplicity and extreme ruggedness and durability, so that it can survive the rugged environment which prevails around metal rolling mills. The cooling water distribution headers or manifolds can be constructed and sized and positioned to provide precisely the optimum volume of coolant across the full width of the strip and at proper intervals along the moving strip to produce the ideal cooling parameters. This is something which has not been attainable in the prior art.

In one form of the invention, the water curtain discharge slot is adjustable by simplified means, and in a second form of the invention, control is attained through valving and adjustability of the manifold outlet is not required.

Other features and advantages of the invention will become apparent during the course of the following description.

BRIEF DESCRIPTION OF DRAWING FIGURES

FIG. 3 is an enlarged longitudinal vertical section taken on line 3—3 of FIG. 1.

FIG. 4 is an enlarged transverse vertical section taken on line 4—4 of FIG. 1.

FIG. 5 is a perspective view showing a modification of the invention.

DETAILED DESCRIPTION

Figure 1:
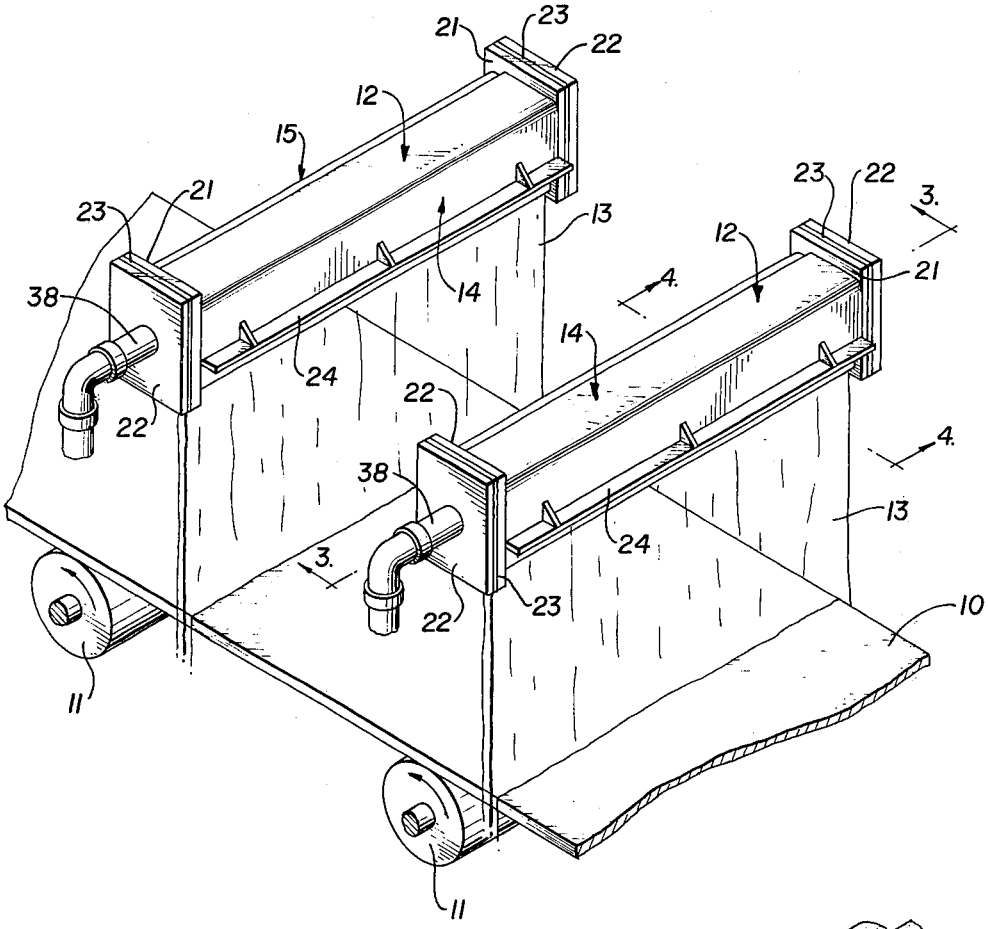
FIG. 1 is a fragmentary perspective view of a runout cooling system for metal rolling mills embodying the invention.
Figure 2:
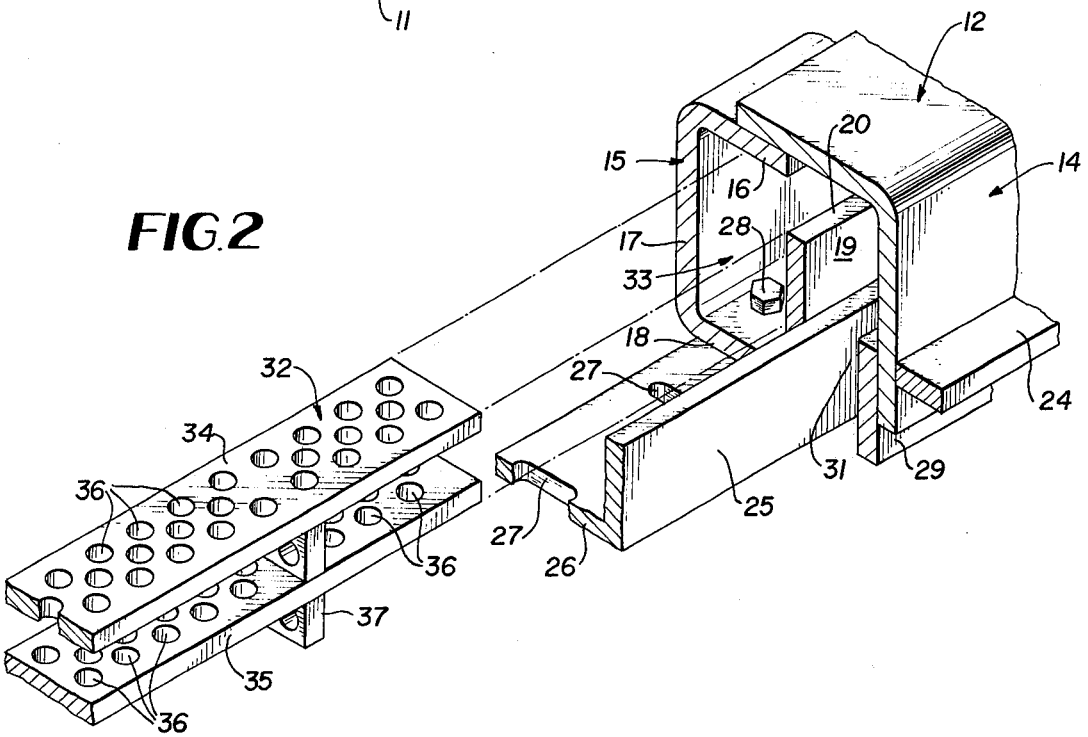
FIG. 2 is an enlarged fragmentary exploded perspective view of an adjustable cooling water manifold according to a preferred embodiment.

Referring to the drawings in detail, wherein like numerals designate like parts, a moving metal strip 10 of uniform thickness and width is supported on a bed of rolls 11 in a metal rolling mill, the support rolls being carried by a conventional base structure, not shown.

In order to cool the strip or plate 10 over its entire width uniformly and in a controlled manner as required for various reasons known in the art, a required number of elevated longitudinally spaced transversely extending parallel cooling water supply headers or manifolds 12 are provided. The number and precise placement of the manifolds 12 can be accurately calculated in terms of the cooling requirements for a given thickness and speed of movement of a particular metal strip 10, and therefore the number, placement and spacing of the manifolds 12 will vary in the invention rather widely. For purposes of illustration only, a pair of manifolds 12 and associated parts have been illustrated for simplicity of illustration. In terms of structure and operation in the system, each cooling water manifold is identical to the others, and therefore a detailed description of one manifold will serve to describe them all.

It may be stated at the outset that the purpose of each manifold 12 is to deliver cooling water to the moving strip 10 in the form of a free-falling solid or continuous curtain or wall 13 of water, as differentiated from spaced or discontinuous multiple streams, sprays or jets commonly employed in the prior art. Each solid water curtain 13 drenches the moving strip 10 with coolant over its entire width and continuously during the operation of the system.

Continuing to refer to the drawings, each header or manifold 12 comprises an elongated sturdy metal body portion which is aapproximately rectangular in cross section and fabricated by welding from an L-shaped bar or section 14 and an interfitting body portion 15 which includes a top wall 16, a right angular side wall 17, a bottom wall 18, parallel to the top wall 16, an an interior upstanding wall 19 parallel to the side wall 17 and located near the transverse center of the header 12. The upper edge 20 of the interior wall 19 is straight and forms a weir lip for the overflow of water which makes up the falling solid water curtain 13. The overlapping top walls of elements 14 and 15 are welded to form a fluid-tight interior chamber, the ends of which carry flange plates 21 and opposing cover plates 22 with suitable gaskets 23 intervened between them.

A stiffening bar 24 is preferably secured by welding to the exterior of the vertical web of body portion 14 to render the manifold structure more rigid adjacent to the point of cooling water discharge, FIG. 4.

To accurately regulate the thickness of the solid water curtain 13 falling from each header 12 of the system, a laterally adjustable gap plate 25 is secured through a right angular horizontal flange 26 having slots 27 to the bottom of wall 18 by clamping bolts 28. In this manner, the gap plate 25 can be adjusted toward or away from an opposing fixed gap plate 29 on the interior of the vertical web 30 of body portion 14. The resulting gap or vertical passage 31, FIG. 4, between the two plates 25 and 29 may thus be regulated to accurately define the thickness of the falling solid water curtain 13 during the operation of the cooling system.

In order to assure even distribution and discharge of water from each header 12 of the system, a diffuser assembly 32 is removably mounted in the main chamber 33 thereof defined by the body portion 15. This diffuser assembly comprises spaced parallel flat upper and lower plates 34 and 35, each having a multiplicity of randomly placed diffusion apertures 36 formed therethrough, as shown. The diffuser assembly further includes apertured leg or support plates 37 which are rigidly joined to the main plates 34 and 35 so as to integrate the assembly 32. The leg plates 37 rest on the floor of chamber 33 in the assembled manifold, and the diffuser assembly 32 is removable as a unit endwise from the manifold 12, when required.

Referring to FIGS. 1 and 3, cooling water from a common supply source, not shown, enters the several manifolds 12 through end pipes 38 suitably joined to one end cover plate 22. Shut-off and control valving, not shown, is provided in the water system. As explained, the thickness of each solid water curtain 13 can be finely regulated by adjustment of the movable gap plate 25 relative to the stationary plate 29.

FIG. 5 shows a modification of the invention wherein a system header or manifold 39, similar to the manifold 12, is provided, but without the feature of the adjustable gap 31 of the prior embodiment. In lieu thereof, a control valve 40 is provided in the water supply pipe 41 of header 39 to regulate the discharge of water from a fixed width side outlet slot 42 of the manifold which extends for its entire length. A fixed angle bar 43 is attached to the outer vertical wall 44 of the manifold body 45 to form a horizontal weir lip over which the cooling water continuously flows to produce a solid curtain or wall of water substantially similar to that shown at 13. In both forms of the invention, the interiors of the manifolds 12 and 39 are entirely flooded during the operation of the system with the water always being in a semi-stored state, although freely discharging through the slot or gap 31 in the prior embodiment, or through the slot 42 in FIG. 5. In the latter case, as mentioned, the volume of flow and hence the thickness of the water curtain 13 is regulated by valve 40 instead of by adjusting the outlet gap of the manifold.

The manifold 39 is approximately rectangular in cross section like the manifold 12 but the body portion 45 can be formed as a single section or tube with the slot 42 formed therein instead of in two pieces, as at 14 and 15 in the prior embodiment.

Each manifold 39 has an internal water diffuser 46 removably mounted therein essentially identical to the diffuser 32 and for the stated purpose. The bar 43 is preferably attached to the side wall 44 of manifold body 45 by sturdy welded brackets 47.

In either form, the invention provides the required number of solid water curtains 13 falling continuously on the moving metal strip 10 to cool it properly. The positioning of the described manifolds relative to the strip 10 allows the system to be constructed for maximum efficiency, and the placing of the manifolds for maximum efficiency, their number and volumetric capacity can be quite accurately calculated. For further fine adjustment, either the movable gap plate 25 or the control valve 40 may be employed.

It is thought that the advantages of the system overall and in the construction of the manifolds 12 and 39, compared to the prior art, will now be apparent to those skilled in the art.

While the manifolds 12 and 39 are described as approximately rectangular, it should be understood that these could be round in cross section or otherwise shaped differently in some cases. Likewise, the shape of the diffuser 32 in the manifold 12 may vary with the intent to reduce the velocity of the cooling water prior to the water flowing through the gap or passage 31. Also, the means of supplying the water to the manifolds 12 or 39 may vary in some cases. For example, water could enter each manifold near its longitudinal center rather than through one end, as illustrated. Other minor variations may be made within the scope of the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An apparatus for cooling a moving metal strip in a rolling mill or the like comprising a cooling water manifold adapted to be mounted at an elevation above said strip for delivering falling water onto the strip, said manifold extending transversely of the strip, said manifold comprising a first approximately L-cross section longitudinal body portion and a mating generally U-cross section longitudinal body portion, said L-cross section body portion having a top wall, a top wall extension on said U-cross section body portion in superposed relationship to said top wall of the L-cross section body portion and fixedly secured thereto, said U-cross section body portion having an interior wall substantially perpendicular to said top walls and having an upper edge spaced substantially below said top walls, said interior wall being disposed near the lateral center of said manifold and being in spaced parallel relationship to the side walls of the L-cross section body portion and U-cross section body portion, there being a main diffuser chamber in said manifold defined by the side and bottom walls of said U-cross section body portion, a diffuser assembly removably mounted in said diffuser chamber and including a pair of vertically spaced parallel apertured diffuser plates, the uppermost diffuser plate disposed substantially flush with said upper edge of said interior wall, a fixed vertical gap plate secured to the interior face of the side wall of said L-cross section body portion and extending below the lower edge of such side wall and below the bottom wall of the U-cross section body portion, said fixed gap plate being substantially coextensive longitudinally with said L-cross section and U-cross section body portions, an adjustable L-cross section gap plate having a vertical wall in spaced parallel opposing relation to the fixed gap plate and defining therewith a variable width vertical water curtain discharge slot extending for substantially the entire length of said manifold and for the full width of said metal strip, the vertical wall of said adjustable gap plate disposed between the fixed gap plate and said interior wall, the adjustable L-cross section gap plate having a bottom wall underlying the bottom wall of the U-cross section body portion and being transversely slotted at longitudinally spaced intervals, the bottom wall of the U-cross section body portion being apertured at longitudinally spaced intervals in registry with the slots of said adjustable gap plate, clamping bolts engaging through said apertures and slots for securing the adjustable gap plate is selected laterally adjusted positions relative to the fixed gap plate, said manifold having cooling water inlet means.

2. An apparatus for cooling a moving metal strip in a rolling mill or the like as defined in claim 1, and said cooling water inlet means positioned at one end of said manifold.

3. An apparatus for cooling a moving metal strip in a rolling mill or the like as defined in claim 2, and at least one removable end plate on the manifold connected with the cooling water inlet means and allowing removal of said diffuser assembly through one end of the manifold.

* * * * *